United States Patent [19]

Hardy

[11] Patent Number: 5,054,222

[45] Date of Patent: Oct. 8, 1991

[54] PROTECTIVE DEVICE FOR THE TRIGGER GUARD OF A GUN

[76] Inventor: Mark L. Hardy, 124 Hwy. 75N, Huntsville, Tex. 77340

[21] Appl. No.: 583,498

[22] Filed: Sep. 17, 1990

[51] Int. Cl.[5] ..... F41A 17/46

[52] U.S. Cl. ..... 42/70.07

[58] Field of Search ..... 42/70.01, 70.06, 70.07, 42/70.11

[56] References Cited

U.S. PATENT DOCUMENTS

| | | | |
|---|---|---|---|
| 965,386 | 7/1910 | Hansen | 42/70.07 |
| 995,237 | 4/1910 | Westcott et al. | 42/70.07 |
| 1,563,250 | 11/1925 | Capon | 42/70.07 |
| 1,569,553 | 1/1926 | Lewis et al. | 42/70.07 |
| 1,686,482 | 10/1928 | Windle | 42/70.07 |
| 1,887,308 | 11/1932 | Jessup | 42/70.07 |
| 2,080,202 | 5/1937 | Drake | 42/70.07 |
| 2,195,693 | 4/1940 | Clifton | 42/70.07 |
| 2,401,482 | 6/1946 | Hendey | 42/70.07 |
| 2,590,516 | 3/1952 | de von Breymann | 42/70.07 |
| 2,709,865 | 6/1955 | Bohenek | 42/70.07 |
| 3,020,663 | 2/1962 | Newson | 42/70.07 |
| 3,022,596 | 2/1962 | Cannon | 42/70.07 |
| 3,064,383 | 11/1962 | Newson, Sr. | 42/70.07 |
| 4,030,221 | 6/1977 | Doobenen et al. | 42/70.07 |
| 4,392,318 | 7/1983 | Daniels | 42/70.07 |
| 4,395,837 | 8/1983 | Durnal | 42/70.07 |
| 4,422,254 | 12/1983 | McQueen | 42/70.07 |
| 4,499,681 | 2/1985 | Bako et al. | 42/70.07 |
| 4,509,281 | 4/1985 | Dreiling et al. | 42/70.07 |
| 4,644,676 | 2/1987 | Stern | 42/70.07 |
| 4,912,867 | 4/1990 | Dukes, Jr. | 42/70.11 |
| 4,916,842 | 4/1990 | Hardy | 42/70.07 |
| 4,934,083 | 6/1990 | Smith | 42/70.07 |

FOREIGN PATENT DOCUMENTS

| | | | |
|---|---|---|---|
| 117 | 8/1899 | Austria | 42/70.07 |
| 446668 | 7/1927 | Fed. Rep. of Germany | 42/70.07 |
| 350867 | 6/1905 | France | 42/70.07 |
| 1134406 | 4/1957 | France | 42/70.07 |
| 483349 | 11/1954 | Italy | 42/70.07 |
| 4626 | of 1905 | United Kingdom | 42/70.07 |
| 6761 | of 1910 | United Kingdom | 42/70.07 |
| 1290330 | 9/1972 | United Kingdom | 42/70.07 |

*Primary Examiner*—Richard W. Wendtland
*Attorney, Agent, or Firm*—Harrison & Egbert

[57] ABSTRACT

A protective device for the trigger guard of a gun having a first plate member, a second plate member pivotally connected to the first plate member, and a spring extending between the first plate member and the second plate member. The spring serves to resist the separation of the first and second plate members until a desired amount of compressive force is exerted on the first and second plate members. This protective device has a block member rotatably connected to an arm of the first plate member. This block is movable between a first position parallel to the first arm and a second position perpendicular to the arm. The first plate member has a plurality of projections that extend perpendicularly outwardly therefrom in the area between the first plate member and the second plate member. The block member has a spring connected thereto for urging the block member in a position outward from to the first plate member.

15 Claims, 3 Drawing Sheets

PROTECTIVE DEVICE FOR THE TRIGGER GUARD OF A GUN

TECHNICAL FIELD

The present invention generally relates to devices used to prevent inadvertent discharge of fire arms. More particularly, the present invention relates to those devices that can be easily removed by adults.

BACKGROUND ART

Many millions of households have handguns for personal protection, and on most of these households the guns are loaded for instant use. These loaded guns present a major safety problem if there are children in the home or if there are likely to be child visitors. The natural curiosity of children leads them to explore the various dressers, drawers, night stands, and other places where loaded guns are frequently kept. The novelty of a real gun is often overwhelming, and children point these guns at each other or at other persons, frequently with tragic results.

Because of the hazards of children, many gun owners seek to immobilize the gun with locks of various types. These generally take the form of a covering for the trigger of the handgun. While such locks are effective, they reduce the protective potential of the various revolvers and automatics because they must be unlocked with a key. In the dark of night, the key must be located, and preferably it must be kept in a separate drawer or piece of furniture than the gun. The key must be fitted, in the dark into the lock and the lock must be removed before the gun is available for use. This cumbersome unlocking procedure has caused many people to forego the safety of a lock and risk the hazards of accidents with children.

In the past, various types of safety covers for trigger guard assemblies have been devised as a safety precaution for preventing the accidental discharge of "unloaded firearms". Most of these types of safety covers have included the provision of a cover assembly hingedly or at least swingably mounted to the firearm. Not only does a hingedly mounted trigger guard hinder a person when firing the firearm, but it also has a tendency to cause the person contemplating using the firearm to maintain the safety cover in an open position so that the trigger of the firearm may be readily accessible should he desire to discharge the firearm.

U.S. Pat. No. 4,916,842, issued on Apr. 17, 1990, to the present inventor, describes a protective device for the trigger guard of a gun. This protective device comprises a first plate member, a second plate member, a first arm that is connected to the first plate member, a second arm connected to the second plate member, and a spring arranged between the first arm and the second arm for resisting at least 25 pounds of compressive force. A plurality of pins are affixed between each of the plate members so as to extend in appropriate locations within the trigger guard of a gun. The compression spring is a tensioned steel strut of arcuate form extending between the first arm and the second arm. In use, when an adult desired to use the gun, the necessary compressive force was exerted on the arms of the protective device so as to separate the plate members from about the trigger guard of the gun.

U.S. Pat. No. 4,030,221 discloses a type of device that has a housing which is fitted over the trigger guard of a gun. This housing engages the trigger guard so that it cannot be removed except by overcoming the strength of a spring. The housing effectively prevents access to the trigger and thereby prevents accidental firing of the gun. This device, however, is a relatively complicated apparatus to manufacture. There are various components for this device. As a result, the cost of manufacturing this product is quite high and as a result the cost to the consumer is also high.

U.S Pat. No. 3,022,596, issued to C. H. Cannon on Feb. 27, 1962, describes a rubber trigger guard that has lugs on the inside area. These lugs help to grip the trigger and act as a flexible guard for the trigger area. In order to remove this safety device, it is necessary to squeeze the guard. Unfortunately, however, the configuration of this device can be removed by children. This device is also manufactured and sized for specific types of trigger guards and is not applicable to a wide variety of applications.

It is an object of the present invention to provide a protective device for the trigger guard of a gun that effectively prevents removal by children.

It is another object of the present invention to provide a protective device for trigger guards that is relatively inexpensive and easy to manufacture.

It is still another object of the present invention to provide a protective device for the trigger guard of a gun that is adaptable to a wide variety of gun sizes, types, and trigger guard shapes.

It is still a further object of the present invention to provide a protective device for a trigger guard that can be quickly and safely removed by adults in times of emergency.

It is still a further object of the present invention to provide a protective device for the trigger guard of a gun that includes a secondary lock mechanism as an additional safeguard.

These and other objects and advantages of the present invention will become apparent from a reading of the attached specification and appended claims.

SUMMARY OF THE INVENTION

The present invention is a protective device for the trigger guard of a gun. Specifically, this protective device is designed so as to allow the removal of the device by adults while preventing the removal by children. The protective device comprises a first plate member, a second plate member pivotally connected to the first plate member, and a spring extending between the first plate member and the second plate member. The spring has a strength suitable for resisting the separation of the first plate member from the second plate member until a desired amount of compression is exerted on the first and second plate members.

The first plate member comprises a first trigger guard plate and a first arm extending outwardly from the trigger guard plate. The arm is in parallel relationship to the trigger guard plate and is longitudinally offset therefrom. The first trigger guard and the first arm are integrally formed together. The second plate member similarly comprises a second trigger guard plate and a second arm that extends outwardly from the second trigger guard plate. The second trigger guard plate is arranged in parallel relationship to the first trigger guard plate. Similarly, the second arm is in parallel relationship to the first arm.

A pivot member is positioned between the first and second plate members. The first trigger guard plate is on the opposite side of the pivot member from the first arm. Similarly, the second trigger guard plate is on the opposite side of the pivot member from the second arm. With respect to this pivot member, the first and second plate members are movable between a position in parallel relationship to each other to a position in angular separation.

A plurality of projections ar attached to the first trigger guard plate. These plurality of projections extend between the first trigger guard plate and the second trigger guard plate. A cam pin is also rotatably attached to the first trigger guard plate. This cam pin is positioned rearwardly of the plurality of pins on the first trigger guard plate.

The spring is positioned in an area of pivotal connection between the first plate member and the second plate member. The spring may be a coil spring having a suitable strength so as to be resistive to the application of compressive force of 25 pounds on the arms of the first and second plate members.

Importantly, the present invention further includes a block member that is rotatably connected to the first arm. The block member is movable between a position parallel to the first arm and a lock position slightly off-center of the perpendicular to the first arm. The block member has a spring that is connected thereto. This spring serves to urge the block member in a position perpendicular to the first arm.

DETAILED DESCRIPTION OF THE INVENTION

Figure 1:
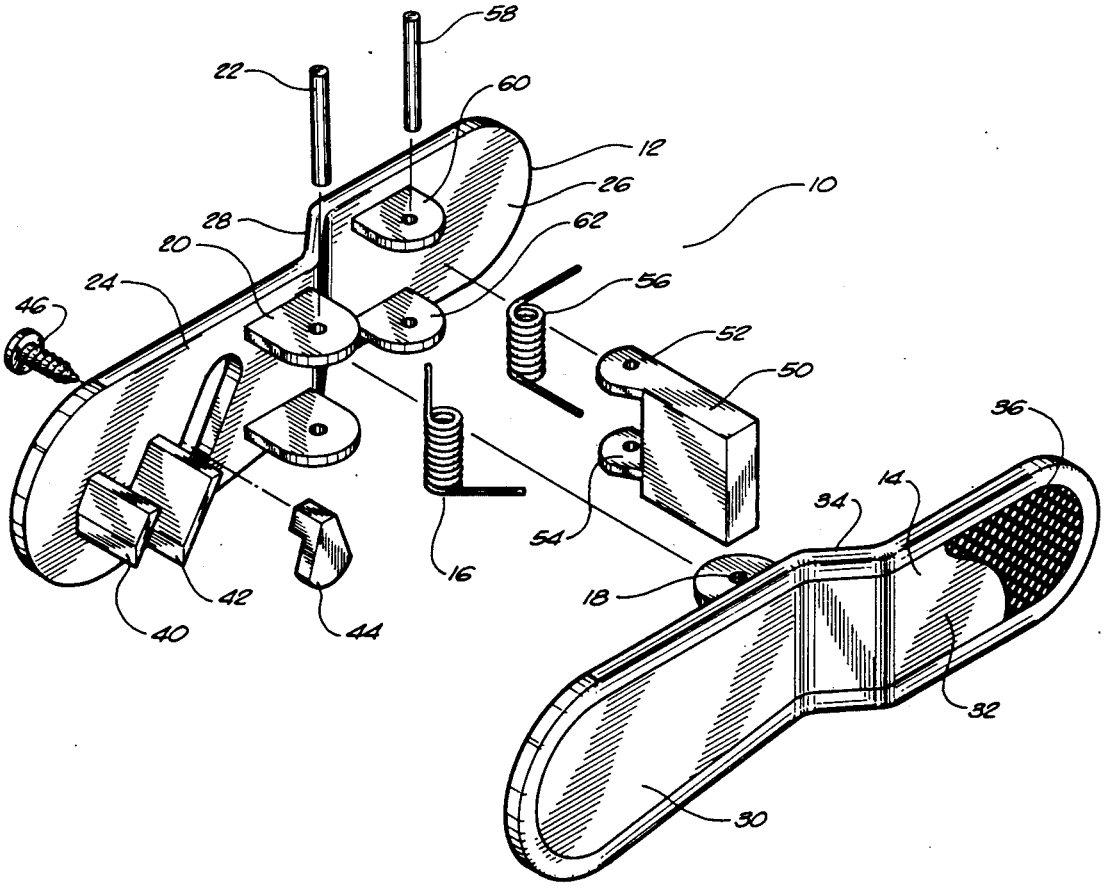
FIG. 1 is an exploded perspective view showing the configuration of the components of the protective device of the present invention.

Referring to FIG. 1, there is shown at 10 the protective device for the trigger guard of a gun. Protective device 10, shown in exploded view in FIG. 1, comprises a first plate member 12, a second plate member 14, and a spring 16. The second plate member 14 is pivotally connected at 18 to the first plate member 12. As illustrated, the spring 16 extends between the first plate member 12 and the second plate member 14. Spring 16 is affixed at pivot point 18 on second plate member 14 and at pivot point 20 of the first plate member 12. A pivot member 22 is inserted through the pivot points 18 and 20 so as to retain the spring 16, the second plate 14, and the first plate 12 in proper position. Spring 16 operates to separate first plate 12 from second plate 14 until a desired amount of compression is exerted on the outer surfaces of the plate members 12 and 14.

The first plate member 12 comprises a first trigger guard plate 24 and a first arm 26. The first arm 26 is integral with the trigger guard plate 24 and extends outwardly therefrom. Specifically, the first arm 26 is connected to the trigger guard plate 24 by an angled section 28. The arm 26 is in generally parallel relationship to the trigger guard plate 24 and is offset longitudinally.

The second plate member 14 has a similar design as the first plate member 12. The second plate member 14 includes a second trigger guard plate 30 and a second arm 32 that extends outwardly from the second trigger guard plate 30. As with the first plate member 12, the arm 32 is connected to the trigger guard plate 30 by an angled portion 34. Arm 32 is parallel to and angularly offset from the trigger guard plate 30. The trigger guard plates 24 and 30 have a size suitable for covering the entire trigger guard area of a gun. As can be seen, the pivot point 18 is connected to the inner surface of the trigger guard plate 30 of the second plate member 14. Pivot point 18 engages the pivot point 20. Pivot point 20 is located on the inner surface of the first trigger guard plate 24. Spring 16 is interposed therebetween. As can be seen, there is a knurled area 36 positioned at the end of arm 32. Knurled area 36 allows the user to have a proper grip on the protective device 10.

As can be seen in FIG. 1, a plurality of projections 40 and 42 extend perpendicularly outwardly from the inner surface 24 of the first plate member 12. Projections 40 and 42 engage the actual trigger and/or trigger guard of a gun when in use. By placing a portion of the trigger guard of a gun in the area adjacent projection 40 and projection 42, the protective device 10 can be properly retained in place. A cam pin 44 is rotatably mounted by threaded member 46 to the trigger guard plate 24 of first plate member 12. Cam pin 44 is positioned rearwardly of the projections 40 and 42. Cam pin 44 can be rotated, as needed, to engage the trigger of a gun.

Spring 16 is positioned in the area of pivotal connection between the first plate member 12 and the second plate member 14. Spring 16 is of a size of quality so as to be resistive to the application of a compressive force of 25 pounds to the arms 26 and 32 of plate members 12 and 14, respectively. In essence, the spring 16 serves to exert the necessary force to avoid the opening of the device by a child.

Another feature of the present invention is the inclusion of block member 50. Block member 50 is rotatably connected to the first arm 26 of first plate member 12. The block member 50 includes pivot portions 52 and 54 extending outwardly beyond one surface of block member 50. A spring 56 is connected within the pivot portions 52 and 54. Finally, a rod 58 passes through pivot members 60 and 62 so as to join the block member 50 to the arm 26 of first plate member 12. Spring 56 serves to exert a force on the block member 50. Specifically, this force urges the block member 50 so as to look in a position in which the block member 50 extends off-center of the perpendicular from the arm 26 to the inner surface of the arm 52 of the second plate member 14.

Figure 2:
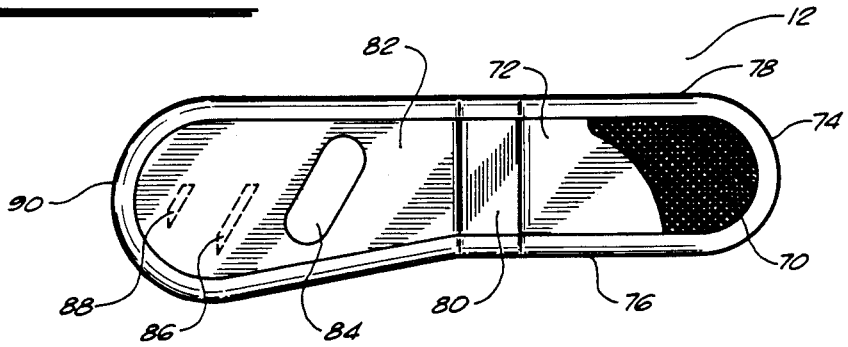
FIG. 2 is a side view of the first arm of the present invention.

FIG. 2 is a side view of the first plate member 12. On the exterior surface of first plate member 12 is a knurled area 70. Knurled area 70 has a configuration similar to that of the area 36 of the second plate member 14, as shown in FIG. 1. The first plate member 12 has an arm portion 72 that is semi-circular at end 70. The sides 76 and 78 of the arm 72 are essentially parallel so as to provide a suitable gripping surface. The angled portion 80 extends from the arm 72 to the trigger guard plate 82. Trigger guard plate 82 has a slightly greater area than that of the arm 72. The trigger guard plate area 82 is designed to have a suitable size so as to cover the trigger guard area of a gun to which the protective device 10 is applied. A slanted opening 84 is formed on the trigger guard plate 82 so as to receive the cam pin 44. The slanting of this open area 84 further enhances the ability of the cam pin to be adaptable to a wide variety of trigger guard sizes. Also, it can be seen that pins 86 and 88 are also slanted so as to properly engage a surface of the trigger guard. The end 90 of the first plate member 12 is also somewhat semi-circular in configuration. In essence, the trigger guard plate 82 acts to seal the trigger guard area of a gun from the intrusion of fingers. It also prevents the hammer of the gun from being cocked. Specifically, it is designed to prevent children from getting their fingers in the trigger guard area in any way.

Figure 3:
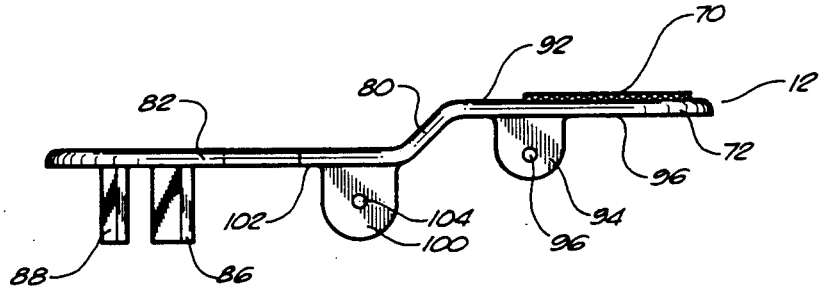
FIG. 3 is a top view showing the first arm in accordance with the preferred embodiment of the present invention.

FIG. 3 is a top view of the first plate member 12 as shown in FIG. 2. Specifically, the knurled area 70 is a thin outwardly extending area on the exterior surface 92 of the arm 72. Pivot portion 94 extends outwardly from the inner surface 96 of the first plate member 12. Pivot portion 94 includes a hole 96 which acts to receive the rod, the spring, and the block member. Slanted area 80 extends inwardly from the arm 72. As can be seen in FIG. 3, the arm 72 is parallel to the trigger guard plate 82. It is also longitudinally offset. Another pivot portion 100 is fastened to the inner surface 102 of the trigger guard plate 82. This pivot portion 100 includes a hole 104 that acts to receive the rod for receiving the spring. Finally, in FIG. 3, it can be seen that the pins 86 and 88 are fastened to the inner surface 102 of trigger guard plate 82.

Figure 4:
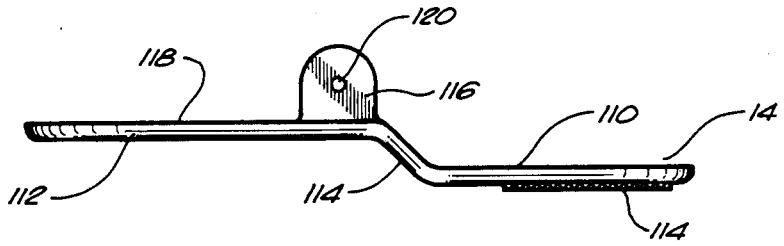
FIG. 4 is a top view showing the configuration of the second arm in accordance with the preferred embodiment of the present invention.

FIG. 4 is a top view of the second plate member 14. Second plate member 14 includes an arm 110 and a trigger guard plate 112. Arm 110 has a knurled area 114 extending outwardly therefrom. The arm 110 is parallel to the trigger guard plate 112 and is connected by slanted portion 114. A pivot portion 116 is fastened to the inner surface 118 of the trigger guard plate 112. The pivot portion 116 is complementary to the pivot portion 100 of the first plate member 12. Pivot portion 116 includes a hole 120 formed therein. Hole 120 will properly align with the hole 104 of the first plate member 12. As stated previously, the trigger guard plate 112 will have a size that corresponds to the size of the trigger guard plate of the first plate member 12. Specifically, this trigger guard plate 112 will have a suitable size for covering the trigger guard area of a gun. The trigger guard plate 112 will be located on the opposite side of the trigger guard area from that of the trigger guard plate 82 of the first plate member 12.

Figure 5:
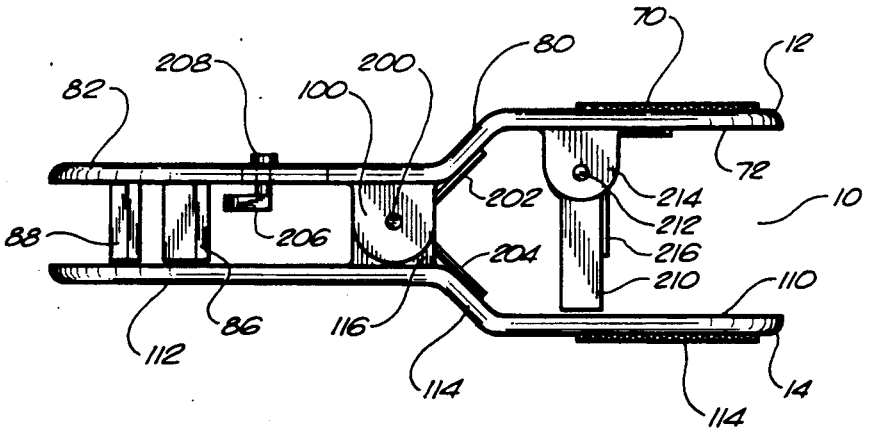
FIG. 5 is a top view showing the trigger guard in accordance with the preferred embodiment of the present invention.

FIG. 5 shows the joining of the first plate member 12 with the second plate member 14. Initially, it can be seen that the first plate member 12 is pivotally connected at 200 to the second plate member 14. The pivot portion 100 of the first plate member 12 overlaps the pivot portion 116 of the second plate member 14. A rod, or pin, extends through the openings 104 and 120 so as to properly align the first plate member 12 and the second plate member 14. It can be seen that the ends 202 and 204 of spring 16 extend outwardly from beyond these pivot portions 100 and 106. Specifically, the ends 202 and 204 are in abutment with the angled portions 80 and 114 of first plate member 12 and second plate member 14, respectively. These ends 202 and 204 exert a suitable force on the plate members 12 and 14 so as to assure that a child will not have sufficient strength so as to squeeze the arms 72 and 110 together. In use, when a suitable pressure is applied to the knurled surfaces 70 and 114 of arms 72 and 110, respectively, then the trigger guard plate members 82 and 112 will angularly separate. As can be seen, the pins 86 and 88 extend between the trigger guard plates 82 and 112. Each of the pins 86 and 88 will be in near abutment with the inner surface of the trigger guard plate 112. When a suitable compressive force is exerted on the arms 72 and 110, then the pins 86 and 88 will move from the trigger guard of a gun and be properly separated therefrom. In FIG. 5, it can be seen that the cam pin 206 is fastened by a threaded member 208 to the trigger guard plate 82 of first plate member 12. The cam pin 206 can be rotated, as needed, so as to block the rearward movement of the trigger of a gun.

Importantly, the block member 210, as normally used, is illustrated in FIG. 5. Block member 210 is fastened by a rod 212 to the pivot portion 214 located on the arm 72 of first plate member 12. Spring 216 exerts a force such that the block member 210 will be generally off-center of perpendicular to the arm 72 of first plate member 12. Block member 210 will have a position that is in near abutment with the inner surface of the arm 110 of the second plate member 14. In this normal position, it is impossible to depress the plate members 12 and 14 together. In operation, to properly remove the protective device 10 from the trigger guard of a gun, it is necessary to push on the block member 10 so that the impedance to the movement of the plate members 12 and 14 is eliminated. It has been found that it is often difficult for children to carry out both actions of pulling the block member 210 and exerting a suitable pressure on the plate members 12 and 14. As such, the block member 210 serves as an additional safeguard for the gun.

The trigger guard plate members 82 and 102 are retained in their proper position about the trigger guard of a gun until such time as the trigger guard requires usage. By applying a compressive force to the arms 72 and 110, and the manipulation of the block member 210, the protective device may be removed from about the trigger guard. Once the protective device is removed from the trigger guard of a gun, the gun is free for use.

The present invention offers significant advantages over the prior art. First, and foremost, the present invention provides adequate protection for the purpose of keeping children from gun usage. At the same time, the present invention allows the user of the gun the ability to use the gun in an emergency situation. The configuration of the protective device allows the user to quickly and easily remove the device from about the trigger guard of a gun. There is no need for keys, complex manual manipulations, levers, or other odd mechanisms that must be actuated so as to free the protective device from the about the trigger. Also, there are no separate pieces that can be separated, lost or misplaced. Additionally, the present invention can be manufactured and sold at a reasonable price. The ability to sell the protective device 10 of the present invention at a reasonable price makes the device very attractive to potential customers. The device is easy to understand and easy to install. Additionally, the present invention is adaptable to a wide variety of trigger guard sizes, shapes, and configurations. As such, the present invention offers a superior protective device to that of the prior art.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A protective device for the trigger guard of a gun comprising:

a first plate member having a first arm extending outwardly therefrom;

a second plate member having a first arm extending outwardly therefrom, said second plate member being pivotally connected to said first plate member; and a block means rotatably connected to said first arm, said block means movable between a first position parallel to said first arm and a second position outward from said first arm, said block means for stopping movement of said first plate member with respect to said second plate member when said block means is in said second position.

2. The protective device of claim 1, further comprising:

spring means extending between said first plate member and said second plate member, said spring means for resisting the separation of said first plate member from said second plate member until a desired amount of compression is exerted on said first arm and said second arm.

3. The protective device of claim 2, further comprising:

a pivot member positioned between said first and second plate members, said pivot member allowing said first plate member to rotate relative to the position of said second plate member.

4. The protective device of claim 1, said first and second plate members movable between a position in parallel relation to each other to a position angularly separated from each other.

5. The protective device of claim 1, further comprising:

a plurality of projections attached to said first plate member, said plurality of projections extending between said first plate member and said second plate member.

6. The protective device of claim 5, further comprising:

a cam pin rotatably attached to said first plate member, said cam pin positioned rearwardly of said plurality of projections.

7. The protective device of claim 2, said spring means positioned in an area of pivotal connection between said first plate member and said second plate member, said spring means being resistive to the application of a compressive force of twenty-five pounds on said first and second plate members.

8. The protective device of claim 1, said block means having a spring connected thereto, said spring for urging said block member in a position outward from said first arm.

9. A protective device for the trigger guard of a gun comprising:

a first plate member comprising:

a first trigger guard plate; and a first arm extending outwardly from said trigger guard plate, said first arm being integrally connected to said first trigger guard plate, said first arm being longitudinally offset from said first trigger guard plate;

a second plate member pivotally connected to said first plate member, said second plate member comprising:

a second trigger guard plate; and a second arm extending outwardly from said trigger guard plate, said second trigger guard plate being in parallel relationship to said first trigger guard plate, said second arm being in parallel relation to said first arm;

spring means extending between said first plate member and said second plate member, said spring means for resisting the separation of said first plate member from said second plate member until a desired amount of compression is exerted on said first and second plate members; and a pivot member positioned between said first and second plate members, said first trigger guard plate being on an opposite side of said pivot member from said first arm, said second trigger guard plate being on an opposite side of said pivot member from said second arm.

10. The protective device of claim 9, said first and second plate members movable between a position in parallel relationship to each other to a position angularly separated.

11. The protective device of claim 9, said first plate member comprising:

a plurality of projections attached to said first trigger guard plate, said plurality of projections extending between said first trigger guard plate and said second trigger guard plate.

12. The protective device of claim 11, said first plate member comprising:

a cam pin rotatably attached to said first trigger guard plate, said cam pin positioned rearwardly of said plurality of projections.

13. The protective device of claim 9, said spring means positioned in an area of pivotal connection between said first plate member and said second plate member, said spring means being resistive to the application of a compressive force of 25 pounds on said first and second plate members.

14. A protective device for the trigger guard of a gun comprising:

a first plate member comprising:

a first trigger guard plate; and a first arm extending outwardly from said trigger guard plate;

a second plate member pivotally connected to said first plate member;

spring means extending between said first plate member and said second plate member, said spring means for resisting the separation of said first plate member from said second plate member until a desired amount of compression is exerted on said first and second plate members; and a block member rotatably connected to said first arm, said block member movable between a position parallel to said first arm and a position outward from said first arm.

15. The protective device of claim 14, said block member having a spring connected thereto, said spring for urging said block member in a position outward from said first arm.

* * * * *